US011549791B1

(12) United States Patent
Futtere

(10) Patent No.: US 11,549,791 B1
(45) Date of Patent: Jan. 10, 2023

(54) BROADHEAD BLADE IMPACT ENERGY TRANSFER APPARATUS AND METHOD

(71) Applicant: Arrowds LLC, Fredericksburg, TX (US)

(72) Inventor: Matthew Futtere, Fredericksburg, TX (US)

( * ) Notice: Subject to any disclaimer, the term of this patent is extended or adjusted under 35 U.S.C. 154(b) by 0 days.

(21) Appl. No.: 17/504,684

(22) Filed: Oct. 19, 2021

Related U.S. Application Data

(60) Provisional application No. 63/094,959, filed on Oct. 22, 2020.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 6,398,676 B1 * 6/2002 Mizek ..... F42B 6/08 473/583
7,393,295 B1 * 7/2008 Futtere ..... F42B 6/08 473/583
7,713,152 B1 * 5/2010 Tentler ..... F42B 6/08 473/583
8,016,704 B1 * 9/2011 Vandewater ..... F42B 6/08 473/583
8,043,177 B2 * 10/2011 Flanagan ..... F42B 6/08 473/583
8,113,974 B1 * 2/2012 Ward, Jr. ..... F42B 6/08 473/583
8,128,521 B1 * 3/2012 Ulmer ..... F42B 6/08 473/583
8,628,438 B1 * 1/2014 Cooper ..... F42B 6/08 473/583
8,905,874 B2 * 12/2014 Sullivan ..... F42B 6/08 473/583
10,057,565 B2 * 8/2018 Powell ..... A63F 13/40
10,077,975 B2 * 9/2018 Haas ..... F42B 6/08
10,205,936 B2 * 2/2019 Powell ..... H04N 13/144
10,837,743 B1 * 11/2020 Beam ..... F42B 6/08

* cited by examiner

*Primary Examiner* — John A Ricci
(74) *Attorney, Agent, or Firm* — J. Nevin Shaffer, Jr.

(57) ABSTRACT

A broadhead blade impact energy transfer apparatus and method consisting of a support structure with a first end and a second end. A blade is rotatably attached with the support structure such that the blade is movable from a first position to a second position where the blade has a leading cutting edge and a trailing edge and a connection point and an extended tip and where the connection point is connected with the support structure. A pressure device is connected in the support structure where the pressure device is configured to pressure the connection point of the blade such that the blade is pressured toward the first end of the support structure and to the first position and to yield to force applied to the blade and enable the blade to move to the second position.

20 Claims, 5 Drawing Sheets

BROADHEAD BLADE IMPACT ENERGY TRANSFER APPARATUS AND METHOD

CROSS REFERENCE TO RELATED APPLICATION

This application claims the benefit of previously filed U.S. provisional patent application No. 63/094,959 filed Oct. 22, 2023 for a "Broadhead Blade Impact Energy Transfer Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a broadhead blade impact energy transfer apparatus and method consisting of a support structure with a first end and a second end. A blade is rotatably attached with the support structure such that the blade is movable from a first position to a second position where the blade has a leading cutting edge and a trailing edge and a connection point and an extended tip and where the connection point is connected with the support structure. A pressure device is connected in the support structure where the pressure device is configured to pressure the connection point of the blade such that the blade is pressured toward the first end of the support structure and to the first position and to yield to force applied to the blade and enable the blade to move to the second position.

BACKGROUND OF THE INVENTION

Humane hunting requires a system for killing prey quickly. Problems exist with current hunting devices, bows and arrows and projectiles in particular, in that, for example, the killing area of the arrow or projectile is difficult to expand without introducing detrimental side effects. Applicant owns various patents on compressible cut width big game animal broadhead technology. One variation of broadhead created by Applicant was a turkey/small game specific design called "The Guillotine" which is a rigid, single, blade design engineered to lop the heads off the target small game animals and birds. The rigid design results in an intense impact energy load that is one-hundred percent applied to the thin, yet very sharp, cutting blade. This impact energy often causes the blade to fail. Replacing broken blades is time consuming and costly. All companies that followed Applicant's basic original design experience this failure mode which has relegated this style of broadheads to one shot typically before the user is required to replace one or more blades.

A "broadhead", as is known in the art, is the sharpened implement mounted on the end of the shaft of an arrow that provides the penetrating and cutting mechanism which results in the ethical and humane killing of the hunted animal. While broadheads are useful hunting tools, they would be even more useful if the rigid design blades could be protected from breaking so as to reduce and/or eliminate the time and expense of constantly replacing them after just one use.

Thus, there is a need in the art for a process that addresses the aforementioned problems in a manner that is robust and flexible so as to accommodate a full spectrum of rigid blade broadhead design and use.

It therefore is an object of this invention to provide an improved broadhead blade that transfers impact energy, reduces blade breakage and increases the life, usefulness and effectiveness of a rigid broadhead blade structure without reducing speed and accuracy and structural integrity.

SUMMARY

Accordingly, the novel broadhead blade energy transfer apparatus consists of a support structure with a first end and a second end. A blade is rotatably attached with the support structure such that the blade is movable from a first position to a second position where the blade has a leading cutting edge and a trailing edge and a connection point and an extended tip and where the connection point is connected with the support structure. A pressure device is connected in the support structure where the pressure device is configured to pressure the connection point of the blade such that the blade is pressured toward the first end of the support structure and to the first position and to yield to force applied to the blade and enable the blade to move to the second position.

As used herein all terms are given their common, "ordinary" meaning. In particular, the term "blade" is used as discussed herein and illustrated in the figures to describe a generally flat device which has a length, width and thickness and whose width and length are much larger than the thickness. A knife blade for example, only. The term "pressure device" is used herein to describe a device that is resilient and that deforms under pressure but returns to a resting state or position after pressure is withdrawn. A resilient metal spring, for example only, once formed stays in a resting position and when pressure is applied deforms and once the pressure is released, the spring returns to its resting position. The pressure device also exerts a pressure against movement or a resisting pressure when pressure is applied. Many metal and plastic devices are known which exhibit such qualities and are well within the abilities of those of ordinary skill in the art.

In another aspect of the invention, the extended tip of the blade is a dull compared to the cutting edge. Again, terms used herein are given their ordinary meaning such that "cutting edge" describes a form designed for normal use to cut, such as a knife edge for example only. On the other hand, a form not configured to cut, such as a butter knife edge, is by comparison "dull".

In one aspect, the extended tip of the blade is dull compared to the cutting edge and C-shaped. "C-shaped" describes a half moon form as shown in the figures. Applicant has determined this form of a dull tip is most effective in transferring impact energy as described more fully hereafter.

In a further aspect, the support structure includes a blade stop such that upon movement of the blade to the second position the trailing edge of the blade contacts the blade stop preventing the blade from moving further such that over compression of the pressure device is prevented and impact energy is transferred to the support structure and away from the connection point.

One aspect further includes more than one blade.

Another aspect further includes a front blade and a rear blade.

In one aspect the apparatus further includes a front blade and a rear blade with a pressure device connected with the front blade and a pressure device connected with the rear blade.

In another aspect, the apparatus further includes a centering device on the blade where the centering device cooperates with the pressure device to center the blade in the first position.

In one aspect, the centering device includes a cam lobe form.

In a further aspect, the pressure device includes a ball bearing contact form configured to transfer pressure from the pressure device to the blade and from the blade to the pressure device.

In one aspect, the centering device includes a cam lobe form and the ball bearing contact form cooperates with the cam lobe form to hold the blade in the extended first position.

According to another embodiment, a broadhead blade impact energy transfer apparatus consists of a support structure with a first end and a second end. A blade is rotatably attached with the support structure such that the blade is movable from a first position to a second position where the blade has a leading cutting edge and a trailing edge and a connection point and an extended tip where the connection point is connected with the support structure and where the extended tip of the blade is a dull compared to the cutting edge. A pressure device is connected behind the blade in the support structure such that the blade is closer to the first end of the support structure than the pressure device and where the pressure device is configured to pressure the connection end of the blade such that the blade is pressured toward the first end of the support structure and to the first position and to yield to force applied to the blade and enable the blade to move to the second position. A blade stop is provided such that upon movement of the blade to the second position the trailing edge of the blade contacts the blade stop and prevents the blade from moving further such that over compression of the pressure device is prevented and impact energy is transferred to the support structure and away from the connection point.

In one aspect, the extended tip of the blade is dull compared to the cutting edge and C-shaped.

In other aspects, the invention includes more than one blade; and/or a front blade and a rear blade; and/or a front blade and a rear blade with a pressure device connected with the front blade and a pressure device connected with the rear blades.

In one aspect, the invention further includes a centering device in the blade configured to cooperate with the pressure device to maintain the blade in the first position.

In another aspect, the centering device includes a cam lobe form.

In a further aspect, the pressure device includes a ball bearing contact form configured to transfer pressure from the pressure device to the blade and from the blade to the pressure device.

According to another embodiment, a broadhead blade impact energy transfer method consists of:

a. providing a support structure with a first end and a second end; a blade rotatably attached with the support structure such that the blade is movable from a first position to a second position where the blade has a leading cutting edge and a trailing edge and a connection point and an extended tip where the connection point is connected with the support structure; and a pressure device connected in the support structure where the pressure device is configured to pressure the connection point of the blade such that the blade is pressured toward the first end of the support structure and to the first position and to yield to force applied to the blade and enable the blade to move to the second position; and b. attaching the structure to an arrow shaft.

In one aspect, the support structure includes a blade stop such that upon movement of the blade to the second position the trailing edge of the blade contacts the blade stop preventing the blade from moving further such that over compression of the pressure device is prevented and impact energy is transferred to the support structure and away from the blade connection point.

In another aspect, the method further includes a front blade and a rear blade with a pressure device connected with the front blade and a pressure device connected with the rear blade.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
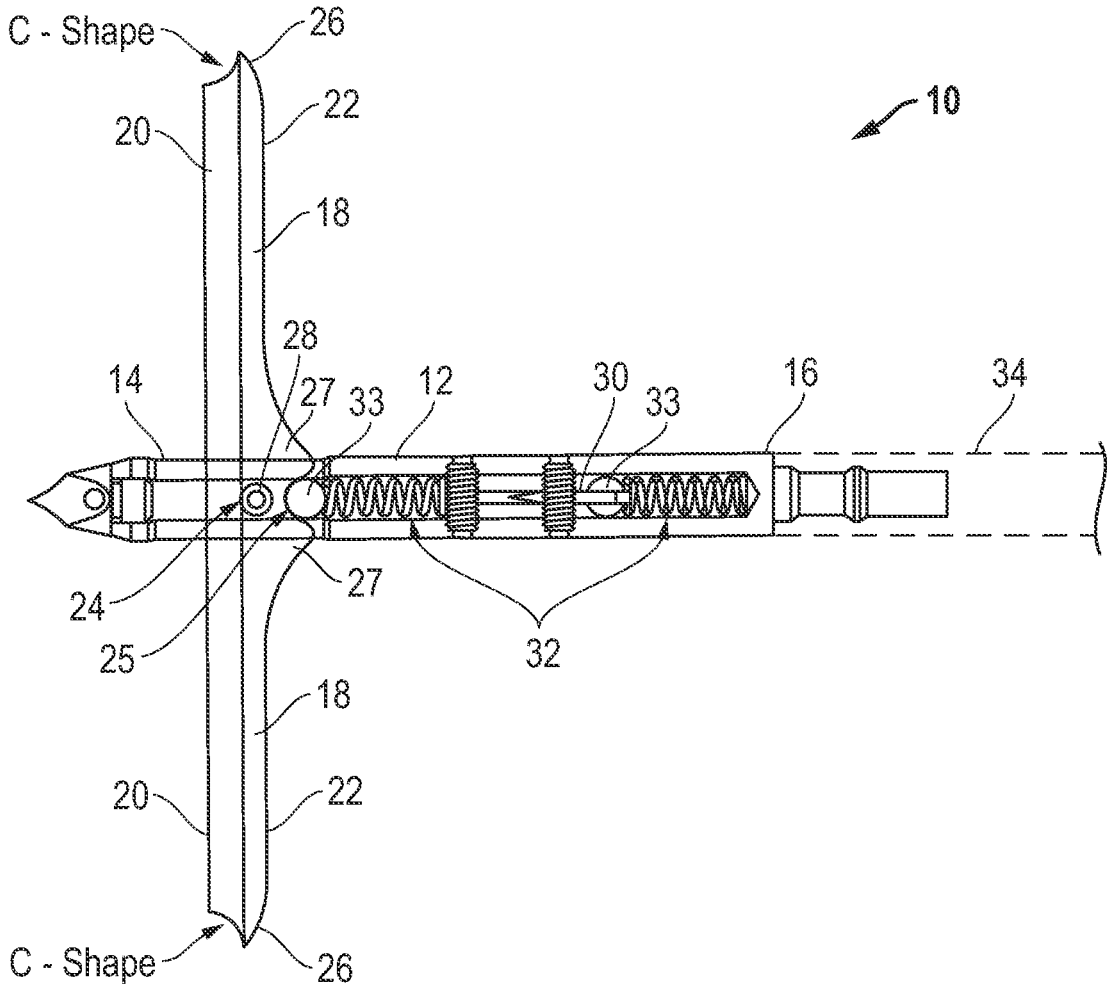
FIG. 1 is a top schematic view of the broadhead blade energy transfer apparatus of the present invention with a front blade and a rear blade in the extended first position with a pressure device behind each of the blades.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of example in FIGS. 1-5. An additional description of the invention is found in the attached Specification_2 submitted herewith and incorporated herein.

Referring to FIG. 1, a broadhead blade energy transfer apparatus 10 consists of a support structure 12 with a first end 14 and a second end 16. A front blade 18 has a leading cutting edge 20 and a trailing edge 22 and a connection point 24 and an extended tip 26 and where the connection point 24 is connected with the support structure 12.

Figure 2:
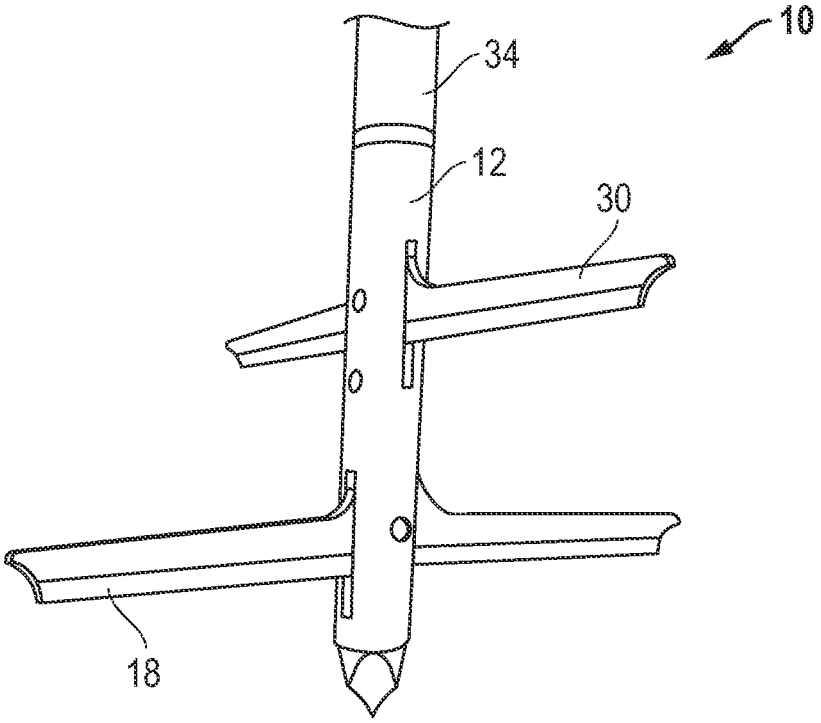
FIG. 2 is a side perspective view of the invention of FIG. 1 without the support structure and showing the front and rear blades in the first position.
Figure 3:
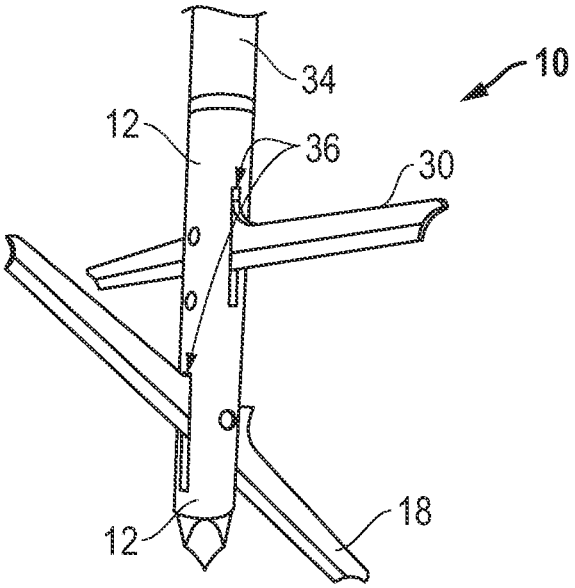
FIG. 3 is a side perspective view of the invention of FIGS. 1 and 2 illustrating the movement of one side of the front blade upon impact to the second position.
Figure 4:
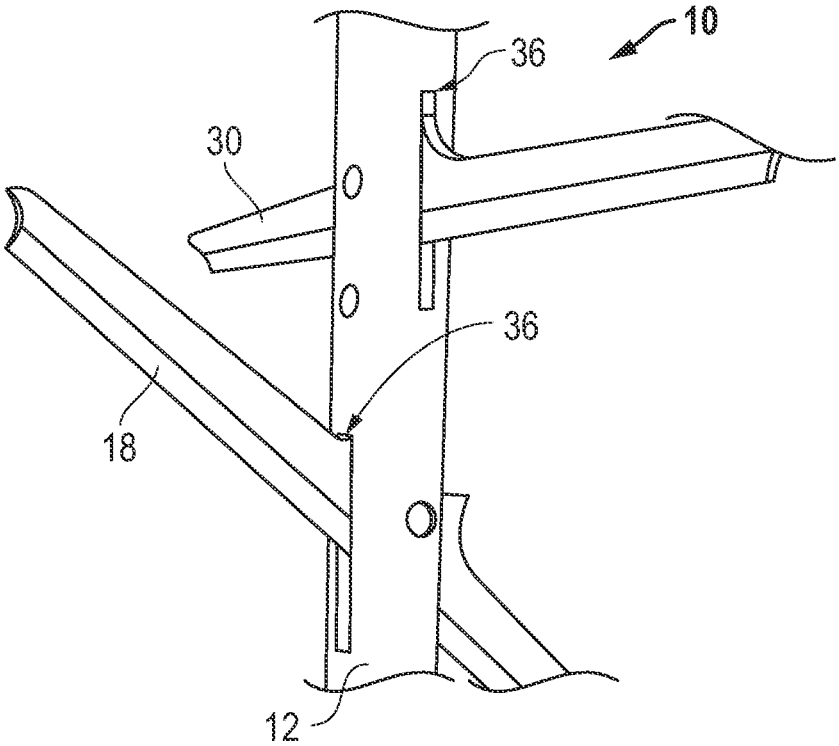
FIG. 4 is a close up side perspective view of FIG. 3 showing the trailing edge of one side of the front blade in contact with the blade stop.
Figure 5:
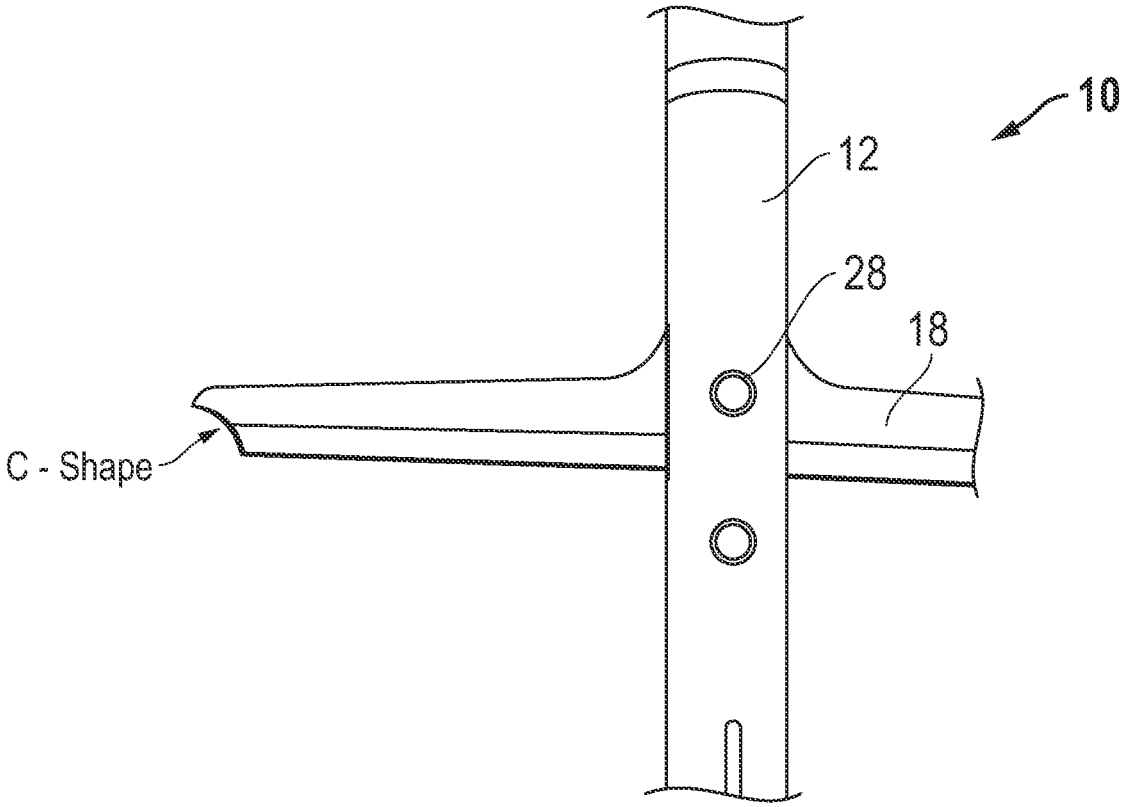
FIG. 5 is a top close up view of the invention of FIG. 1 showing the dull, C-shaped extended tip of the blade.

FIG. 1 shows a single front blade 18 as is preferred for "Guillotine" type devices. Front blade 18 is rotatably attached with the support structure 12 by pivot connection 28 at connection point 24 such that the blade 18 is rotatably movable from a first ("extended") position as shown in FIGS. 1 and 2, to a second ("compressed") position as shown in FIGS. 3-4. By "compressed" it is meant that one side of the single blade 18 rotates away from contact as shown. As shown, preferably there are more than one blades as with a blade 18 and, as shown, preferably a rear blade 30 (seen end on in FIG. 1).

A pressure device 32 is connected with the front blade 18 behind, preferably, the front blade 18 (and the rear blade 30 when present), That is, the front blade 18 is closer to the first end 14 of support structure 12 than the pressure device 32. In other words, pressure device 32 is located behind front blade 18 (and rear blade 30 when present) in support structure 12 as illustrated. Certainly, the pressure device 32 may be located in other places relative to the blades such as in front of the front blade 18, for example only and not by limitation.

Wherever it is located, pressure device 32 is configured to pressure the front blade 18 to the fully extended first position, essentially, perpendicular to the support structure 12 as shown in FIGS. 1 and 2 such that front blade 18 is pressured toward the first end 14 of the support structure 12 and to the first position. In operation, however, pressure device 32 yields to force applied to the front blade 18 and enables the front blade 18 to move to the second position shown in FIGS. 3 and 4.

Figure 6:
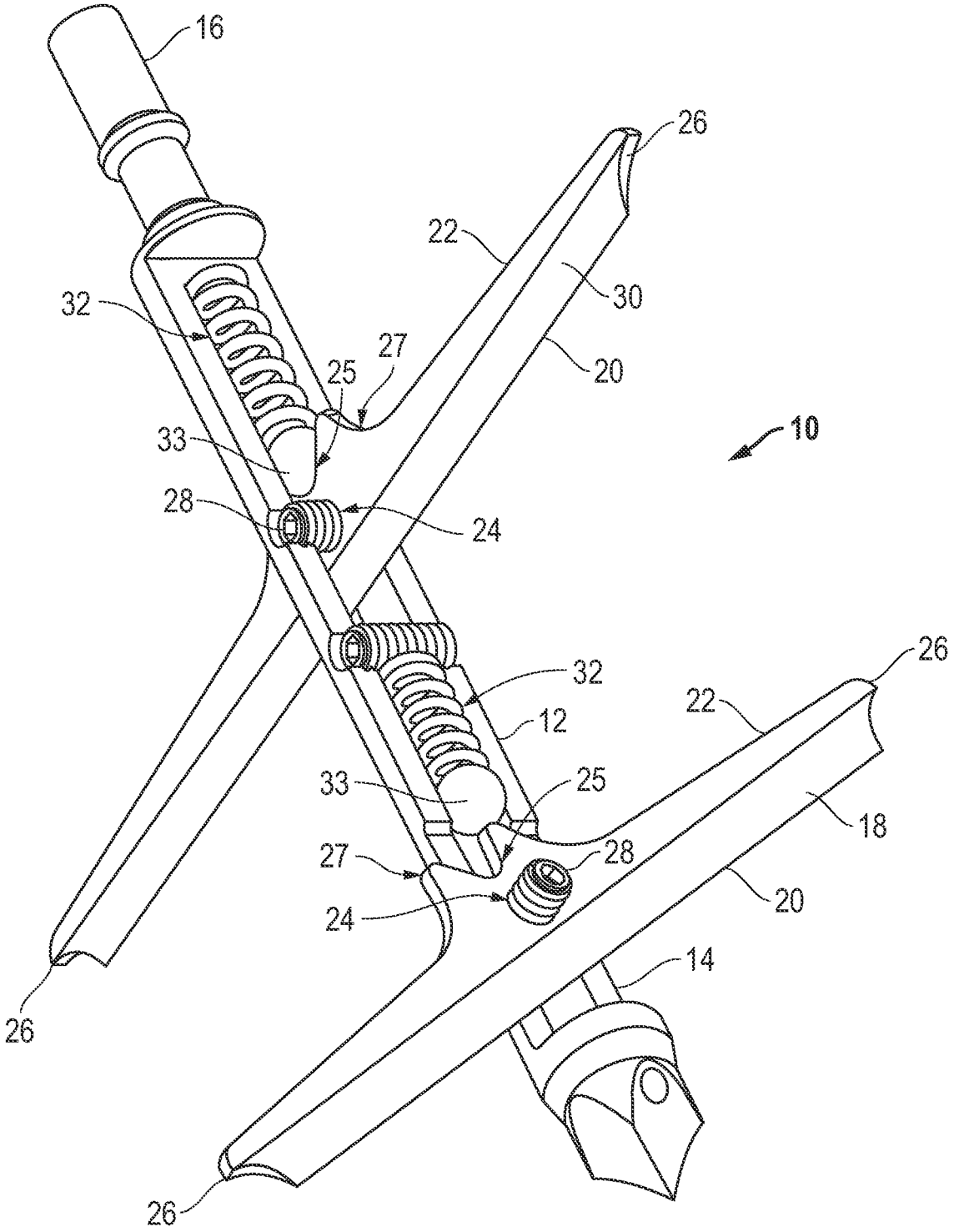
FIG. 6 is a perspective cut away view of the invention of FIG. 1 showing the operation of the centering device in a front blade and a rear blade.

Referring to FIG. 6, the front blade 18, and rear blade 30 when present, include a centering device 25 at the connection point 24. Centering device 25 co-operates with the pressure device 32 to automatically align and reset front blade 18 to the first position, perpendicular to support structure 12. As shown, pressure device 32 preferably includes a ball bearing contact form 33 that contacts the centering device 25. The ball bearing contact form 33 is forced against the centering device 25 and the cam lobe form 27 of centering device 25 causes the front blade 18 to rotate around pivot connection 28 to return to the first position. Likewise, centering device 25 moves upon contact of the front blade 18, extended tip 26, with a target and the cam lobe form 27 of centering device 25 compresses pressure device 32 allowing blade 18 to move to the second position.

FIG. 6 shows the operation of centering device 25 where the front blade 18 shows the preferred cam lobe form 27 of the centering device 25 on the blade 18 forcing the allowed full compression distance of pressure device 32. However, FIG. 6 shows clearly that the structure of the cam lobe form 27 of centering device 25 ensures that the spring element of the pressure device 32 is not fully, or over, compressed and so will not be damaged.

FIG. 6 also illustrates by way of the rear blade 30, the "Ready to shoot" position where spring force/ball bearing, pressure device 32 and the centering device 25 of the blade 30 interact so as to self-align the blade 30 with respect to the support structure 12 in the preferred, repeatable horizontally extended first position.

In operation, the extended tip 26 of a front blade 18, which is dull compared to cutting edge 20, impacts the target but does not cut through the target as the cutting edge 20 does. Instead, extended tip 26 absorbs the impact energy and transfers it to the front blade 18. Pressure device 32 yields under this impact pressure and allows front blade 18 to rotate backwards to the second position. This feature alone greatly enhances the likelihood that the single extended "rigid" front blade 18 will not break at impact as is the case in the art presently. In one aspect, the extended tip 26 of the blade 18 is dull compared to the cutting edge and also C-shaped. "C-shaped" describes a half moon form as shown in the figures. Applicant has determined this C-shaped form of a dull tip 26 is most effective in absorbing and transferring impact energy as described more fully hereafter.

FIG. 1 also illustrates in dashed lines an arrow shaft 34 to which support structure 12 may be removably attached, as is known in the art.

Referring now to FIGS. 3 and 4, in a preferred embodiment of the present invention, the support structure 12 includes a blade stop 36 such that upon movement of the blade 18 to the second position (See FIGS. 3 and 4) the trailing edge 22 of one side of the blade 18 contacts the blade stop 36 preventing the blade 18 from moving further. As shown, blade 18 extends from support structure 12 in a slot 38. Blade stop 36 is located at the rear end of the slot 36 such that further rearward movement of blade 18 is prevented. Blade stop 36 may be the end of the slot 38 formed by the support structure 12 itself or a reinforced area at that point, for example only and not by limitation. In any event, blade stop 36 operates such that over compression of the pressure device 32 is prevented and residual impact energy is transferred to the support structure 12 and away from the rotatable blade attachment, pivot connection 28. Applicant has determined that this structure greatly reduces blade fracture and breakage by spreading residual impact energy not absorbed initially to the support structure 12 itself and away from the pivot connection 28 alone.

Preferably, again, as illustrated, a second, rear, blade 30 is provided. As with front blade 18, preferably pressure device 32 is present in this configuration as well and operates as described with regard to front blade 18.

By way of further description, this novel approach applies Applicant's patented "blade compressibility" in a reverse manner compared to big game animal broadheads. This means that the present structure is engineered to provide a high enough impact load resistance from the extended dull 26 tip via a cam shaped 27 centering device 25 and blade/ball bearing/spring interaction, pressure device 32, (as illustrated) to easily and ethically kill the target animal. The present invention instantly allows the blade to yield position (from the extended first position to the collapsed second position) to reduce impact energy on the blade by providing a spring compression distance break over point to the compression capability. This centering device cam action transfers blade impact force through a ball bearing and spring (the preferred embodiment of pressure device 32) which compresses to absorb the load. Additionally, blade stop 36 acts to continue to transfer any residual energy to the support structure 12 body of the broadhead and arrow shaft. The pressure device 32 absorbs the majority of the potential harmful blade destructive energy and allows time for the transfer of residual energy from the broadhead blade to the broadhead body/arrow shaft 34 through blade stop 36. Through this suspension loading capability, the present invention tremendously increases the durability and instant reusability of the rigid blade, "Guillotine" style, category of small game/bird broadheads. In sum, the present invention protects blade 18, and 30 when present, from breaking and damage.

An additional unique aspect of this present design structure is that of the geometry interaction between the load bearing surface of, for example, a "Ball Bearing" or similar hardened wear ball bearing contact form 33, between blade 18 and the rest of pressure device 32. The unique geometry of the blade 18, or plurality of blades, in combination with centering device 25, is engineered to move the blade 18 from a set static "first" position to a lesser "second" position during and after impact with the target animal. It is also a critically unique structural cam lobe 27 design of centering device 25 that uses this spring force/ball bearing contact form 33 geometry of the pressure device 32 to "Self Align" the blade to the same physical position. Meaning, the spring force of pressure device 32 wedges the steel ball bearing 33 into the blade cam lobe 27 geometry of centering device 25 and holds the blade 18 in the desired firing, extended first position, automatically. The cam lobe 27 geometry of centering device 25 is also engineered in such a manner so as to allow absorption of the impact energy via pressure device 32, such as any spring like/compressible material as known, which compresses and rebounds to the initial resting state and thus resets to the "Ready to fire" position. Thus additionally solving for, and allowing achievement of, repeatable aerodynamic properties that enhance need of repeatable accuracy with all sharpened blades utilized on both fixed mechanical and such guillotine style broadheads.

Another unique aspect of the present invention is that each of the extended tip 26 ends of the blades 18 includes a section of blade 18 where there is no sharp feature. Instead, this section is dull compared to the cutting edge 20 and is a section engineered to be a first strike section of the blade 18. Because it is "dull" it drags a bit on contact with a target instead of cutting through it. Thus, this structure utilizes leverage force to begin the compression cycle without damaging the blade 18 as described herein. This complete system delivers the balance to achieve beheading of the bird/small game animal for a quick, ethical kill with a so called rigid blade structure. Yet this structure also includes impact absorption and energy transfer so as to reduce blade breakage and enhance tremendously the durability and instant reusability of the broadhead. Uniquely, the shape of geometry of the centering device 25 and resulting control of forces encountered in use also ensures that the pressure device 32 is never over compressed and damaged through normal or abnormal use.

Further, the body of the broadhead is engineered to compliment, at full compression of the blade to the second position, to provide mechanical support of the blade on the backside at the blade stop 36 so all of the residual energy is not focused upon the mounting through connection point 24 hole/set screw/pivot point 28 interaction. This mechanical support interaction with the backside trailing edge 22 of the blade 18 some distance away from the through hole/set screw mounting/pivot connection point 24 and pivot connection 28 location further substantially aids in increased durability and usability.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A broadhead blade impact energy transfer apparatus comprising:

a. a support structure with a first end and a second end;

b. a blade rotatably attached with the support structure such that the blade is movable from a first position to a second position wherein said blade has a leading cutting edge and a trailing edge and a connection point and an extended tip wherein the connection point is connected with the support structure;

c. a pressure device connected in said support structure wherein said pressure device is configured to pressure said connection point of said blade such that said blade is pressured toward said first end of said support structure and to the first position and to yield to force applied to the blade and enable said blade to move to the second position; and d. a centering device on said blade wherein the centering device cooperates with the pressure device to center the blade in the first position.

2. The apparatus of claim 1 wherein the extended tip of said blade is a dull compared to the cutting edge.

3. The apparatus of claim 1 wherein the extended tip of the blade is dull compared to the cutting edge and C-shaped.

4. The apparatus of claim 1 wherein the support structure includes a blade stop such that upon movement of said blade to the second position said trailing edge of said blade contacts said blade stop preventing said blade from moving further such that over compression of said pressure device is prevented and impact energy is transferred to the support structure and away from the blade connection point.

5. The apparatus of claim 1 further including a front blade and a rear blade.

6. The apparatus of claim 1 further including a front blade and a rear blade with a pressure device connected with the front blade and a pressure device connected with the rear blade.

7. The apparatus of claim 1 wherein the centering device includes a cam lobe form.

8. The apparatus of claim 1 wherein the pressure device includes a ball bearing contact form configured to transfer pressure from the pressure device to the blade and from the blade to the pressure device.

9. The apparatus of claim 8 wherein the centering device includes a cam lobe form and the ball bearing contact form cooperates with the cam lobe form to hold the blade in the extended first position.

10. A broadhead blade impact energy transfer apparatus comprising:

a. a support structure with a first end and a second end;

b. a front blade and a rear blade rotatably attached with the support structure such the front blade and rear blade are movable from a first position to a second position wherein said front blade and rear blade have a leading cutting edge and a trailing edge and a connection point and an extended tip wherein the connection point is connected with the support structure and wherein the extended tip of said front blade and rear blade is dull compared to the cutting edge;

c. a pressure device connected behind both said front blade and said rear blade in said support structure such that the front blade and the rear blade are closer to the first end of the support structure than said pressure device to which it is connected and wherein said pressure device is configured to pressure said connection point of said front blade and said rear blade such that said blades are pressured toward said first end of said support structure and to the first position and to yield to force applied to the blades and enable said blades to move to the second position; and d. a blade stop such that upon movement of either said front blade or said rear blade to the second position said trailing edge of said blade contacts said blade stop and prevents said blade from moving further such that over compression of said pressure device is prevented and impact energy is transferred to the support structure and away from the connection point.

11. The apparatus of claim 10 wherein the extended tip of the blade is C-shaped.

12. The apparatus of claim 10 further including a centering device in the front blade and the rear blade configured to co-operate with the pressure device to maintain the front blade and the rear blade in the first position.

13. The apparatus of claim 12 wherein the centering device includes a cam lobe form.

14. The apparatus of claim 10 wherein the pressure device includes a ball bearing contact form configured to transfer pressure from the pressure device to the front blade and to the rear blade and from the front blade and the rear blade to the pressure device.

15. The apparatus of claim 14 wherein the centering device includes a cam lobe form and the ball bearing contact form cooperates with the cam lobe form to hold the front blade and the rear blade in the extended first position.

16. A broadhead blade impact energy transfer method consisting of:

a. providing a support structure with a first end and a second end; a blade rotatably attached with the support structure such that the blade is movable from a first position to a second position wherein said blade has a leading cutting edge and a trailing edge and a connection point and an extended tip wherein the connection end is connected with the support structure; and a pressure device wherein said pressure device is configured to pressure said connection point of said blade such that said blade is pressured toward said first end of said support structure and to the first position and to yield to force applied to the blade and enable said blade to move to the second position and a centering device on said blade wherein the centering device cooperates with the pressure device to center the blade in the first position; and b. attaching said support structure to an arrow shaft.

17. The method of claim 16 wherein the support structure includes a blade stop such that upon movement of said blade to the second position said trailing edge of said blade contacts said blade stop preventing said blade from moving further such that over compression of said pressure device is prevented and impact energy is transferred to the support structure and away from the blade connection point.

18. The method of claim 16 further including a front blade and a rear blade with a pressure device connected with the front blade and a pressure device connected with the rear blade.

19. The method of claim 16 wherein the extended tip of said blade is a dull compared to the cutting edge.

20. The method of claim 16 wherein the pressure device includes a ball bearing contact form configured to transfer pressure from the pressure device to the blade and from the blade to the pressure device.

* * * * *